US008516959B2

(12) United States Patent
Dumenil et al.

(10) Patent No.: US 8,516,959 B2
(45) Date of Patent: Aug. 27, 2013

(54) SILK-SCREEN PRINTING MACHINE AND ASSOCIATED PRINTING METHOD

(75) Inventors: Francois Dumenil, Chaumes en Brie (FR); Jean-Louis Dubuit, Paris (FR)

(73) Assignee: Machines Debuit, Noisy le Grand (FR)

( * ) Notice: Subject to any disclaimer, the term of this patent is extended or adjusted under 35 U.S.C. 154(b) by 563 days.

(21) Appl. No.: 12/576,792

(22) Filed: Oct. 9, 2009

(65) Prior Publication Data

US 2010/0089260 A1 Apr. 15, 2010

(30) Foreign Application Priority Data

Oct. 13, 2008 (FR) ..... 08 56935

(51) Int. Cl.
*B05C 17/06* (2006.01)

(52) U.S. Cl.
USPC ..... 101/126; 101/115; 101/123

(58) Field of Classification Search
USPC ..... 101/115, 126, 123, 124, 129
See application file for complete search history.

(56) References Cited

U.S. PATENT DOCUMENTS

| | | | | |
|---|---|---|---|---|
| 5,899,143 | A | 5/1999 | Niestrath et al. | |
| 5,996,486 | A * | 12/1999 | Karlyn et al. | 101/123 |
| 6,510,787 | B2 | 1/2003 | Douville | |
| 6,546,859 | B1 | 4/2003 | Troncon et al. | |
| 6,651,554 | B1 * | 11/2003 | Williams | 101/126 |
| 7,163,267 | B2 * | 1/2007 | Dumenil | 347/2 |
| 7,631,597 | B2 * | 12/2009 | Dumenil | 101/123 |
| 7,669,528 | B2 * | 3/2010 | Dubuit et al. | 101/126 |
| 7,849,792 | B2 * | 12/2010 | Bauer et al. | 101/44 |
| 2005/0087083 | A1 * | 4/2005 | Dumenil | 101/115 |
| 2005/0155500 | A1 * | 7/2005 | Latos et al. | 101/126 |
| 2006/0288888 | A1 * | 12/2006 | Wieland | 101/35 |
| 2007/0022883 | A1 | 2/2007 | Dubuit et al. | |

FOREIGN PATENT DOCUMENTS

| | | |
|---|---|---|
| DE | 196 14 740 | 10/1997 |
| EP | 1 093 912 | 4/2001 |
| EP | 1 736 313 | 12/2006 |
| FR | 2 811 610 | 1/2001 |
| FR | 2 886 577 | 12/2006 |

OTHER PUBLICATIONS

French Search Report dated Mar. 4, 2009, from corresponding French application.

* cited by examiner

*Primary Examiner* — Ren Yan
(74) *Attorney, Agent, or Firm* — Young & Thompson

(57) ABSTRACT

The invention relates to a silk-screen printing machine (2) comprising a frame (4), a plate (6) for transporting the objects (18, 20), which plate (6) is mobile relative to the frame, a first (10) and a second (12) printing station, means (7) for displacing the plate (6) in order to bring the objects (18, 20) into alignment with the printing stations, and an object support (22) capable of carrying a first (18) and a second (20) object. The first printing station (10) is capable of printing solely the first object (18). The second printing station (12) is capable of printing solely the second object (20). The displacement means (7) are suitable for displacing the object support (22) between the first (10) and the second (12) printing station after the first object (18) has been printed at the first printing station (10) and the second object (20) has been printed at the second printing station (12).

14 Claims, 3 Drawing Sheets

SILK-SCREEN PRINTING MACHINE AND ASSOCIATED PRINTING METHOD

BACKGROUND OF THE INVENTION

1. Field of the Invention

The invention relates to a machine and a method for the silk-screen printing of flat objects, such as compact discs, telephone cards or solar cells.

2. Description of the Related Art

Such printing machines are mounted in a production line which extends linearly. The objects are moved from one work station to another by conveyors. The work stations carry out different operations of manufacturing, printing and packaging the objects.

For those assembly lines, it is desirable to produce printing machines which operate at high speed and which have a small space requirement.

In particular, it is desirable to multiply by two the rate at which the objects are printed.

To that end, a printing machine is known which comprises a printing station capable of printing two objects at the same time.

That printing machine comprises a circular plate driven in rotation relative to a support frame. The circular plate carries object supports on which two objects to be printed are arranged. The printing station is mounted around the circular plate.

The silk-screen printing screen of the printing station is suitable for covering the two objects to be printed. It carries two patterns to be printed. During its displacement, the same doctor blade of the printing station is capable of applying the first pattern to the first object and the second pattern to the second object.

However, in that type of printing machine, the objects to be printed have to be positioned on the object support with a high degree of precision, it being necessary for the position of one object relative to the other to be identical when each pair of objects is deposited since the position of one pattern relative to the other cannot be modified.

BRIEF DESCRIPTION OF THE INVENTION

The object of the present invention is to provide a printing machine which operates at high speed, and yet has a small space requirement, and which permits a high degree of printing precision.

To that end, the invention relates to a machine for the silk-screen printing of an object to be printed, the machine comprising:

- a support frame;
- a plate for transporting the objects, which plate is mobile relative to the frame;
- work stations secured to the frame along the periphery of the transport plate, the work stations comprising a first printing station;
- means for displacing the transport plate in order to bring the objects into alignment with the work stations;
- at least one object support carried by the transport plate, the object support being capable of carrying a first and a second object;

characterized in that the work stations comprise a second printing station, the first printing station being capable of printing solely the first object, the second printing station being capable of printing solely the second object; and in that the means for displacing the transport plate are suitable for displacing the object support between the first and the second printing station after the first object has been printed at the first printing station and the second object has been printed at the second printing station.

According to particular embodiments:

- the transport plate is a circular plate which rotates about its centre (A), and each printing station comprises:
  - a platform secured to the frame;
  - a silk-screen printing screen on which a pattern to be printed is placed;
  - a screen support carried by the platform;
  - at least one doctor blade carried by the platform, the doctor blade being capable of pressing the meshwork of the screen in order to apply the printing pattern to the object;
  - means for displacing the doctor blade, which means are carried by the platform, the doctor blade being displaced along a predefined path, the distance between the centre of the transport plate and the straight line perpendicular to the path and passing through the middle of that path having a non-zero length,
- the said distance has a length at least equal to half the length of the path of the doctor blade,
- the same pattern is placed on the silk-screen printing screen of the first printing station and on the silk-screen printing screen of the second printing station,
- each printing station comprises means for regulating the position of the screen support which are capable of displacing the screen support over a range of displacement, and the range of displacement of the screen support of the first printing station covers a region of the object support different from the region covered by the range of displacement of the screen support of the second printing station,
- the regulating means of the first printing station are distinct from and independent of the regulating means of the second printing station,
- the printing machine comprises:
  - at least one visualization camera carried by the frame, the camera being suitable for visualizing the first and the second object placed on the object support;
  - a control unit capable of determining the position of the first and the second object;
  - the control unit being suitable for controlling the regulating means of the first printing station independently from the position of the screen support of the second printing station;
- the machine comprises a first and a second drying station which are secured to the frame along the periphery of the transport plate, the first and the second drying station being arranged downstream of the first and the second printing station, respectively, when viewed in the direction of displacement of the transport plate; the first and the second printing station each being suitable for printing the printing pattern twice on the first and the second object, respectively.

The invention relates also to a method for the silk-screen printing of objects to be printed, which comprises the following steps:

- displacing a transport plate relative to a support frame in order to bring a first object into alignment with a first printing station, the first printing station being secured to the frame along the periphery of the transport plate, a first and a second object being carried by the same object support carried by the transport plate;
- printing solely the first object at the first printing station;
- displacing the transport plate in order to bring the second object into alignment with a second printing station, the second printing station being secured to the frame along the periphery of the transport plate; and printing solely the second object at the second printing station.

BRIEF DESCRIPITION OF THE DRAWINGS

The invention will be better understood on reading the following description which is given purely by way of example and with reference to the appended drawings, in which.

DETAILED DESCRIPTION OF THE PREFERRED EMODIMENTS

Figure 1:
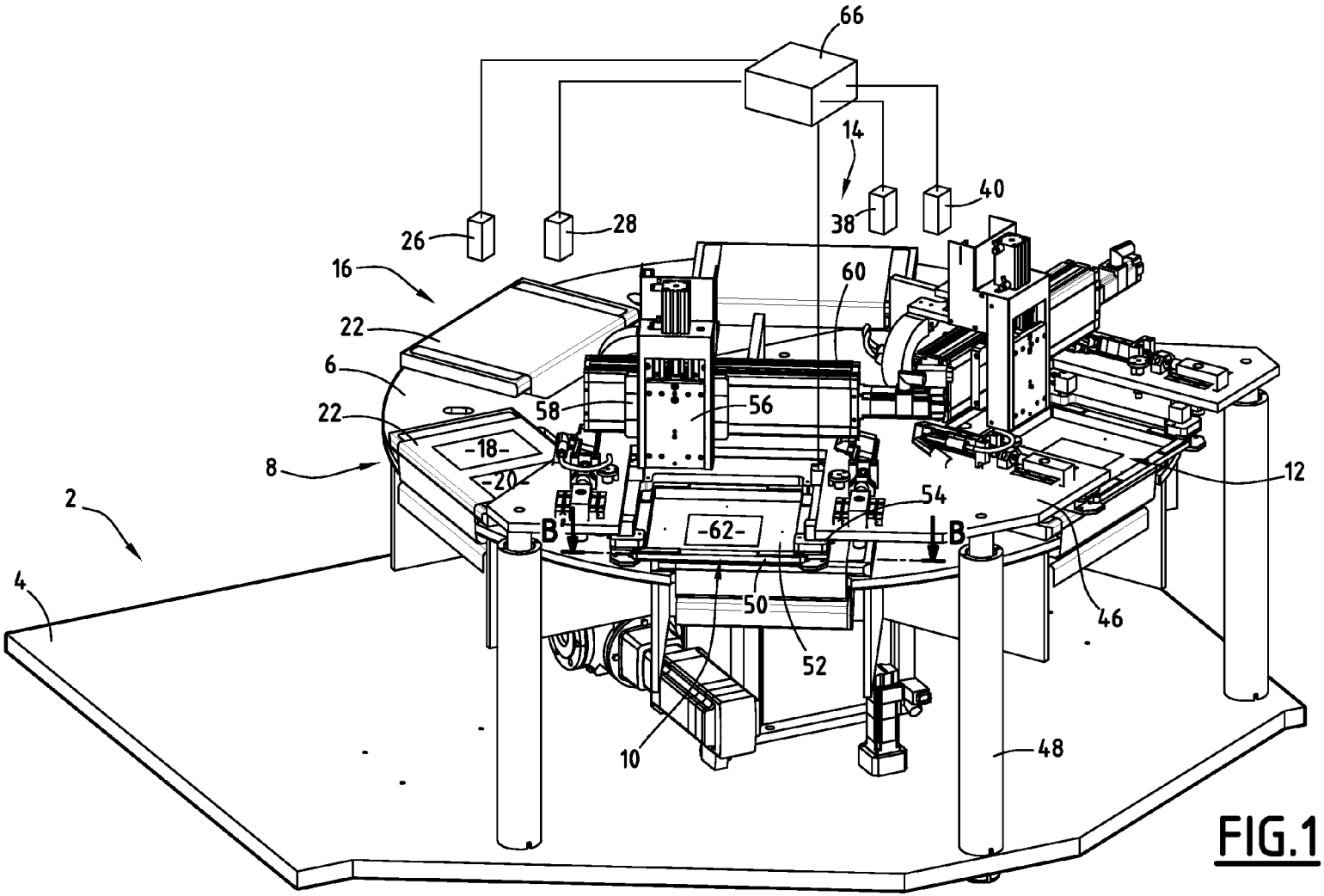
FIG. 1 is a perspective view of the printing machine according to the invention.

Referring to FIG. 1, the printing machine 2 according to the invention comprises a frame 4 supporting a plate 6 in the form of a disc, means 7 for the sequential driving in rotation of the plate 6 relative to the frame 4, and five processing stations 8, 10, 12, 14, 16.

The drive means 7 are capable of driving the transport plate 6 in rotation through an angle of $2\pi$/the number of object supports, that is to say, in the described example of the invention, through an angle of $\pi/3$.

The rotary plate 6 ensures that a first 18 and a second 20 object to be printed are moved from one processing station to another.

It carries six object supports 22 capable of carrying the objects 18, 20 and holding them in position.

Such an object support 22 is described in the patent application filed under the number FR 08 54198 in the name of the Applicant.

The rectangular object supports 22 are located on the rotary plate 6 in such a manner that two of their sides are parallel with a tangent to the transport plate 6. They are regularly angularly spaced so that an angle of 60° separates them two by two.

Figure 2:
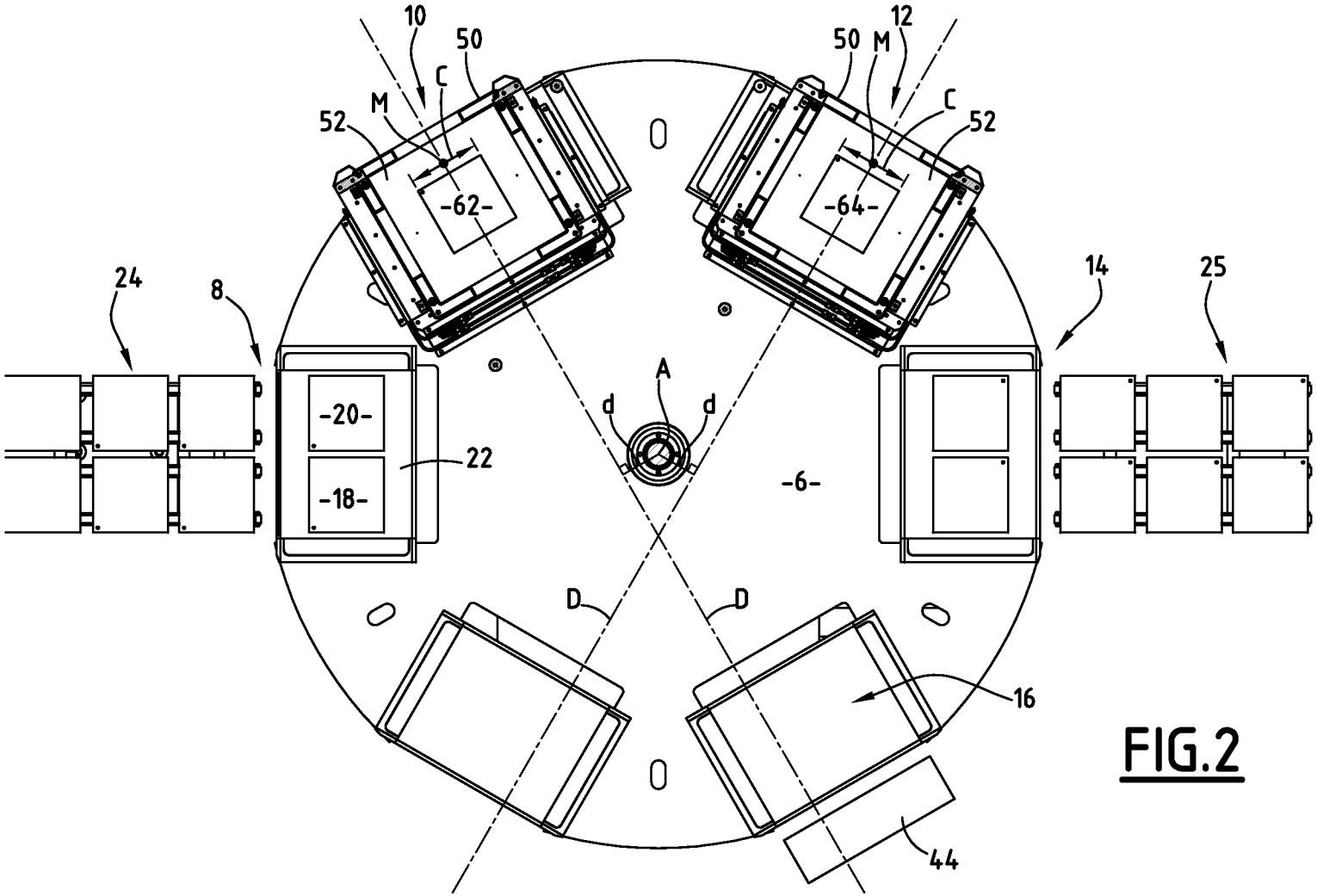
FIG. 2 is a top view of a portion of the printing machine above the plane B-B' shown in FIG. 1, and of the conveyors for delivering and removing the objects to be printed.
Figure 3:
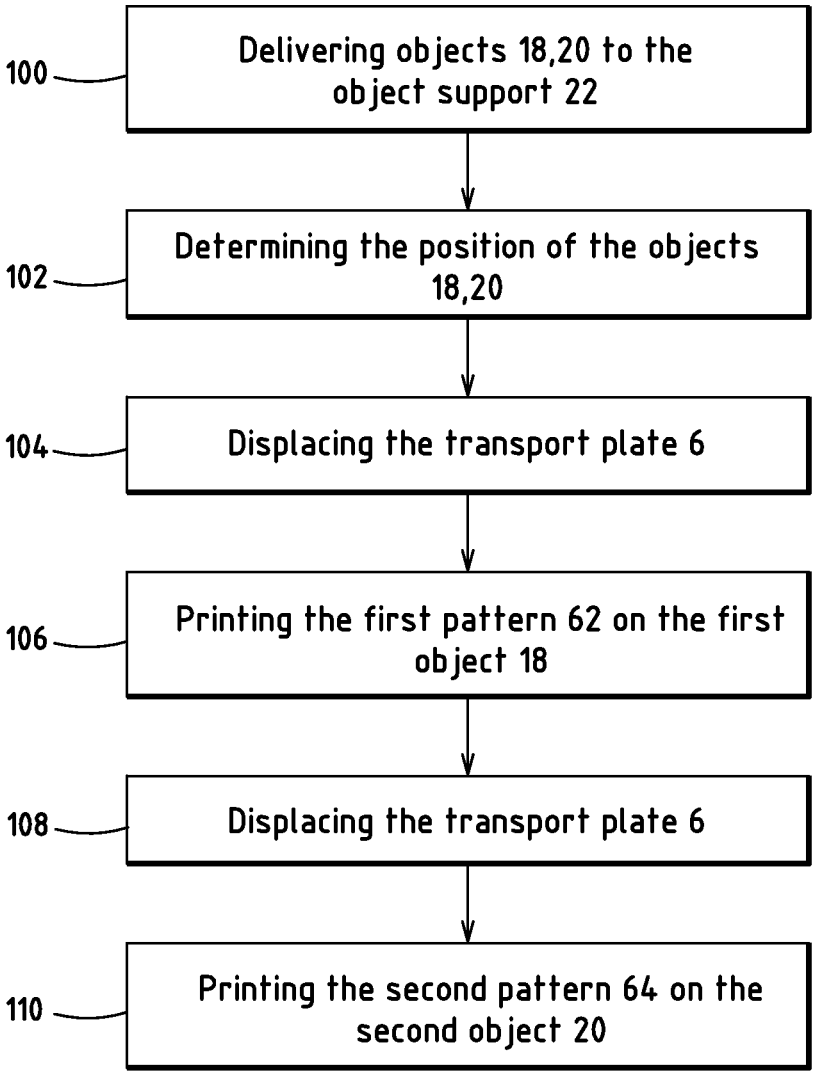
FIG. 3 is a diagram illustrating the steps of the printing method according to the invention.

Each object support 22 is also suitable for transferring the objects 18, 20 from a delivery conveyor 24 shown only in FIG. 2 to the transport plate 6 and from the plate 6 to a removal conveyor 25.

The delivery conveyor 24 is capable of delivering, to the vicinity of the object support 22, two objects 18, 20 to be printed which are arranged side by side, each on a conveyor belt maintained between two parallel motorized return rollers.

The objects 18, 20 are placed on the object support 22 side by side, one side of the objects 18, 20 extending parallel with the long side of the object support 22.

The object supports 22 are suitable for transporting the objects to the removal conveyor 25 when they have been printed correctly.

The removal conveyor 25 is identical to the delivery conveyor 24.

The processing stations 8, 10, 12, 14, 16 are arranged at the periphery of the transport plate 6 in alignment with each object support 22. They comprise a station 8 for locating the position of the objects 18, 20, a first 10 and a second 12 printing station, a station 14 for monitoring the printing quality of the printed objects, and finally a station 16 for discharging spoilt or poorly printed objects.

The locating station 8 comprises two cameras 26, 28 which are each capable of visualizing a portion of the object support 22, on which portion an object 18, 20 to be printed has been placed.

The monitoring station 14 comprises monitoring cameras 38, 40 suitable for visualizing the objects 18, 20 after printing.

The waste discharge station 16 comprises a container 44 for storing the spoilt objects after printing.

Referring to FIG. 1, the first printing station 10 comprises a platform 46 secured by an underframe 48 to the frame 4.

The platform 46 carries a support 50 for a silk-screen printing screen 52, and means 54 for regulating the position of the screen support 50 in a radial direction relative to the rotary plate 6 and in a direction perpendicular to the radial direction.

The regulating means 54 are capable of displacing the screen support 50 over a range of a few millimeters in order to adjust the position of the screen 52 in accordance with the position of each object 18, 20. For, when the objects are transferred from the delivery conveyor 24 to the object support 22, they are positioned only with a precision of a few millimeters.

The range of displacement of the screen support 50 of the second printing station 12 covers a region of the object support 22 different from the region covered by the range of displacement of the screen support 50 of the first printing station.

In particular, the range of displacement of the screen support 50 of the first printing station 10 covers a region in which the first object 18 is capable of being positioned, while the range of displacement of the screen support 50 of the second printing station covers a region of the object support 22 capable of receiving a second object 20.

The platform 46 also carries a system 56 comprising a doctor blade and a counter-doctor blade which are suitable for moving vertically under the action of a jack, and a carriage 58 supporting the doctor blades and the jack. The carriage 58 is guided on a support beam 60 secured to the platform 46 and extending in accordance with a parallel to the tangent to the plate 6.

The doctor blade and counter-doctor blade system 56 is capable of pressing the meshwork of the screen 52 in order to apply a first pattern 62 to the first object 18.

The doctor blade and the counter-doctor blade 56 are displaced by the carriage 58 along a predefined path C which is parallel with a tangent to the transport plate 6.

The length of the path C is approximately equal to the length of the pattern to be printed.

The first printing station 10 is spaced angularly from the locating station 8 by an angle equal to $\pi/6-\alpha$, the angle $\alpha$ being defined as follows:

$\alpha=C/2R$ where C is the length of the path of displacement of the doctor blade and R is the radius of the plate 6.

Consequently, and bearing in mind the fact that the plate is driven sequentially through an angle of $\pi/3$, the first printing station 10 is offset relative to the object support 22 in such a manner as to be centred, not between the first 18 and the second 20 object, but in the centre of the first object 18.

In other words, considering a straight line D perpendicular to the path C of the doctor blade and passing through the middle M of the path, that straight line D does not pass through the centre A of the transport plate 6.

In particular, the minimum distance d between the centre of the plate 6 and the straight line D is equal to half the length of the path C of the doctor blade 56.

$$d=\min\{|A,x|, \text{with } x\in D\}$$

The second printing station 12 is identical to the first printing station 10.

The second pattern 64 placed on the silk-screen printing screen 52 of the second printing station 12 is identical to the pattern 62 placed on the silk-screen printing screen 52 of the first printing station 10.

Likewise, the second printing station 12 is spaced angularly from the monitoring station 14 by an angle of $\pi/6-\alpha$.

Thus, the first 10 and the second 12 printing stations are spaced angularly by an angle of $\pi/6-2\alpha$.

The printing machine 2 also comprises a control unit 66 capable of receiving the images filmed by the cameras 26, 28 and of determining the position of the first 18 and the second 20 objects on the basis of those images.

The control unit 66 is suitable for controlling the means 54 for regulating the screen support 50 of the first printing station 10 in order to position that screen support 50 in such a manner as to dispose the first printing pattern 62 in alignment with the first object 18.

Likewise, and independently, the control unit 66 commands the displacement means 54 of the second printing station 12 to place the second printing pattern 64 in alignment with the second object 20.

In operation, in the course of a step 100, the objects 18, 20 to be printed are delivered by the delivery conveyor 32 to the vicinity of the locating station 8.

The objects 18, 20 are moved from the delivery conveyor 24 to the object support 22 of the locating station 8.

In the course of a step 102, the cameras 26, 28 visualize the location of the objects 18, 20 and transmit the images so filmed to the control unit 66.

The control unit 66 determines the position of the objects 18, 20 by software means and transmits to the regulating means 54 commands for the displacement of the screen support 52 of the first printing station 10 and different commands to the regulating means 54 of the second printing station 12.

In the course of a step 104, the drive means 7 cause the circular plate 6 to pivot through an angle of $\pi/3$, that is to say, through an angle of 60°.

In the course of a step 106, the doctor blade and counter-doctor blade system 56 is displaced in order to apply the first printing pattern 62 to the first object 18. In the course of that step, the second object 20 is not printed.

In the course of a step 108, the drive means 7 cause the transport plate 6 to pivot through an angle of $\pi/3$.

In the course of a step 110, the doctor blade and counter-doctor blade system 56 of the second printing station 12 is displaced in order to apply the second printing pattern 64 to the second object 20.

The first object 18 is not printed in the course of that step.

In the course of a step 112, the transport plate 6 is displaced through an angle of $\pi/3$ in order to deliver the object support 22 to the monitoring station 14. The monitoring cameras 38, 40 film the first 18 and the second 20 object, respectively, and transmit those images to the control unit 66.

The control unit 66 determines whether those objects 18, 20 are broken or spoilt.

When the objects are not broken or spoilt, the object support 22 is commanded to transfer the objects 18, 20 to the removal conveyor 27.

If the objects are spoilt, the control unit 66 commands the object support 22 to transfer the objects to the storage container 44 of the waste discharge station 16 when the transport plate 6 has been driven in rotation through an angle of $\pi/3$.

In a variant, the plate 6 comprises ten object supports 22 and the printing machine comprises a locating station followed, in the order of rotation of the plate, by a first printing station, a first drying station, a second printing station, a second drying station and finally a station for monitoring and discharging the objects.

As in the case of the first embodiment of the invention, the object support 22 is capable of carrying two objects to be printed. The first printing station is suitable for printing solely the first object and the second printing station is capable of printing solely the second object.

The printing machine according to that variant of the invention is used when it is desired to print the same pattern twice on the same object. In that case, the loading of the transport plate 6 is carried out sequentially after two rotations of the plate. The use of a drying station enables the same object to be printed a second time with the same printing station, the object not having moved from its object support between two printing operations.

That variant is particularly advantageous when printing solar cells because a double printing of a pattern on a solar cell makes it possible to increase the thickness of the lines which are to collect the current of the cell, and thus to increase the energy efficiency of the solar cell so formed.

The invention claimed is:

1. A machine for silk-screen printing of an object to be printed, the machine comprising:

a support frame;

a plate configured to transport objects, the plate being mobile relative to the frame;

work stations secured to the frame along a periphery of the transport plate, the work stations comprising a first printing station, and a second printing station, the first and second printing stations each comprising a platform carrying a support for a silk-screen printing screen, and regulating means for displacing the screen support over a range of displacement;

means for displacing the transport plate to bring the objects into alignment with the work stations; and at least one object support carried by the transport plate, the object support being configured to carry a first object and a second object so as to present the first and second objects jointly to each work station, the first and second objects being presented jointly together to one of the work stations at a same time, wherein the range of displacement of the screen support of the first printing station covers a first region of the object support in which the first object is configured to be positioned, and the range of displacement of the screen support of the second printing station covers a second region of the object support in which the second object is configured to be positioned, the second region being different from the first region, so that the second printing station is configured to print the second object and not the first object, and the first printing station is configured to print the first object and not the second object.

2. The printing machine according to claim 1, wherein the transport plate is a circular plate which rotates about a center thereof, and wherein each printing station comprises:

the platform secured to the frame, the silk-screen printing screen on which a pattern to be printed is placed, the screen support carried by the platform, at least one doctor blade carried by the platform, the doctor blade being configured to press the meshwork of the screen to apply the printing pattern to the respective object;

means for displacing the doctor blade the doctor blade displacing means being carried by the platform, the doctor blade being displaced along a predefined path, a distance between the center of the transport plate and a straight line perpendicular to the path and passing through a middle of the path having a non-zero length.

3. The printing machine according to claim 2, wherein the distance has a length at least equal to half the length of the path of the doctor blade.

4. The printing machine according to claim 3, wherein the same pattern is placed on the silk-screen printing screen of the first printing station and on the silk-screen printing screen of the second printing station.

5. The printing machine according to claim 3, further comprising:

at least one visualization camera carried by the frame, the camera being configured to visualize the first and the second objects placed on the object support;

a control unit configured to determine the position of the first and the second objects the control unit being configured to control the regulating means of the first printing station irrespective of the position of the screen support of the second printing station.

6. The printing machine according to claim 2, wherein the same pattern is placed on the silk-screen printing screen of the first printing station and on the silk-screen printing screen of the second printing station.

7. The printing machine according to claim 6, further comprising:

at least one visualization camera carried by the frame, the camera being configured to visualize the first and the second objects placed on the object support;

a control unit configured to determine the position of the first and the second objects the control unit being configured to control the regulating means of the first printing station irrespective of the position of the screen support of the second printing station.

8. The printing machine according to claim 2, further comprising:

at least one visualization camera carried by the frame, the camera being configured to visualize the first and the second objects placed on the object support;

a control unit configured to determine the position of the first and the second objects the control unit being configured to control the regulating means of the first printing station irrespective of the position of the screen support of the second printing station.

9. The printing machine according to claim 1, wherein the regulating means of the first printing station is distinct from and independent of the regulating means of the second printing station.

10. The printing machine according to claim 1, further comprising:

at least one visualization camera carried by the frame, the camera being configured to visualize the first and the second objects placed on the object support; and a control unit configured to determine the position of the first and the second objects the control unit being configured to control the regulating means of the first printing station irrespective of the position of the screen support of the second printing station.

11. The printing machine (2) according to claim 1, further comprising a first drying station and a second drying station which are secured to the frame along the periphery of the transport plate, the first and the second drying stations being arranged downstream of the first and the second printing stations, respectively, when viewed in the direction of displacement of the transport plate, the first and the second printing stations each being configured to print a printing pattern twice on the first and the second objects, respectively.

12. The printing machine according to claim 1, wherein a position of the first object and a position of the second object are determine, and the printing machine further comprises a control unit configured to control each of the means for regulating the position of the screen support based on the determined positions of the first object and the second object.

13. The printing machine according to claim 12, wherein the control unit transmits to the regulating means commands for the displacement of the screen support of the first printing station different from commands for the displacement of the screen support of the second printing station, based on the determined positions of the first object and the second object.

14. The printing machine according to claim 1, wherein the object support is configured to transfer the first and second objects from a delivery conveyor to the transport plate, and from the transport plate to a removal conveyor.

* * * * *

UNITED STATES PATENT AND TRADEMARK OFFICE

CERTIFICATE OF CORRECTION

PATENT NO. : 8,516,959 B2
APPLICATION NO. : 12/576792
DATED : August 27, 2013
INVENTOR(S) : Francois Dumenil et al.

It is certified that error appears in the above-identified patent and that said Letters Patent is hereby corrected as shown below:

On the title page, please amend Item (73) to read as follows:

-- (73) Assignee: Machines Dubuit, Noisy le Grand (FR) --

Signed and Sealed this
Twenty-ninth Day of October, 2013

Teresa Stanek Rea

Teresa Stanek Rea
*Deputy Director of the United States Patent and Trademark Office*